US007364019B2

(12) United States Patent
Faletto

(10) Patent No.: US 7,364,019 B2
(45) Date of Patent: Apr. 29, 2008

(54) MACHINE-ROOM-LESS TRACTION SHEAVE ELEVATOR

(75) Inventor: Luciano Faletto, Arese (IT)

(73) Assignee: Hillston Finance Limited c/o Aleman, Cordero, Galindo & Lee Trust (BVI) Limited, Tortola (VG)

( * ) Notice: Subject to any disclaimer, the term of this patent is extended or adjusted under 35 U.S.C. 154(b) by 304 days.

(21) Appl. No.: 10/497,811

(22) PCT Filed: Jul. 15, 2002

(86) PCT No.: PCT/EP02/07902

§ 371 (c)(1),
(2), (4) Date: Jun. 4, 2004

(87) PCT Pub. No.: WO03/048020

PCT Pub. Date: Jun. 12, 2003

(65) Prior Publication Data

US 2005/0087397 A1 Apr. 28, 2005

(30) Foreign Application Priority Data

Dec. 4, 2001 (IT) ..... MI2001A2558

(51) Int. Cl.
*B66B 11/02* (2006.01)

(52) U.S. Cl. ..... 187/401; 187/411; 187/250; 187/254

(58) Field of Classification Search ..... 187/254, 187/250, 397, 401
See application file for complete search history.

(56) References Cited

U.S. PATENT DOCUMENTS 5,370,205 A * 12/1994 Vanhala ..... 187/264
5,740,888 A * 4/1998 Aulanko et al. ..... 187/336
5,823,298 A * 10/1998 Aulanko et al. ..... 187/266
5,971,109 A * 10/1999 Aulanko et al. ..... 187/263
6,148,962 A * 11/2000 Hakala et al. ..... 187/254
6,230,845 B1 * 5/2001 Yamakawa et al. ..... 187/391
6,247,557 B1 * 6/2001 Kobayashi et al. ..... 187/266
6,336,523 B1 * 1/2002 Ozeki et al. ..... 187/391
6,488,126 B1 * 12/2002 Yamakawa et al. ..... 187/391
6,651,780 B1 * 11/2003 Hakala et al. ..... 187/254
6,739,432 B2 * 5/2004 Elsener ..... 187/401
2003/0106747 A1 * 6/2003 Sasaki ..... 187/373
2004/0206580 A1 * 10/2004 Ishii et al. ..... 187/264
2005/0087397 A1 * 4/2005 Faletto ..... 187/254

FOREIGN PATENT DOCUMENTS

| | | |
|---|---|---|
| DE | 19712646 | 10/1998 |
| DE | 29923919 | 8/2001 |
| EP | 0415218 | 3/1991 |
| EP | 0578237 | 7/1993 |
| EP | 0565956 | 10/1993 |

(Continued)

*Primary Examiner*—Patrick Mackey
*Assistant Examiner*—Terrell Matthews
(74) *Attorney, Agent, or Firm*—Dilworth & Barrese, LLP

(57) ABSTRACT

The present invention is about a traction sheave elevator, without the machine room, comprising an elevator car that runs on guide rails placed in the shaft and connected to at least one hoisting rope un-coiling on a diverting pulley driven by a traction sheave. The invention's characteristic consists in comprising a space, outside the elevator shaft, which houses, at least partially, the traction sheave and is equipped with an opening near a floor's door for the access to the drive machine and to the traction sheave, from outside the shaft. The invention also provides for arranging the two diverting pulleys on the counterweight and on the elevator car in a way that one or the other can be tilted with respect to the vertical or arranging them on the same axis and on the same body of the pulley with the grooves of the alternating hoisting ropes.

20 Claims, 5 Drawing Sheets

FOREIGN PATENT DOCUMENTS

| | | |
|---|---|---|
| EP | 0631968 | 1/1995 |
| EP | 0565956 | 6/1996 |
| EP | 0922663 | 11/1997 |
| EP | 1057771 | 12/2000 |
| EP | 0680920 | 3/2005 |
| EP | 0719724 | 8/2005 |
| WO | 99/48791 | 9/1999 |
| WO | WO 9948791 A1 * | 9/1999 |

* cited by examiner

Fig. 6A
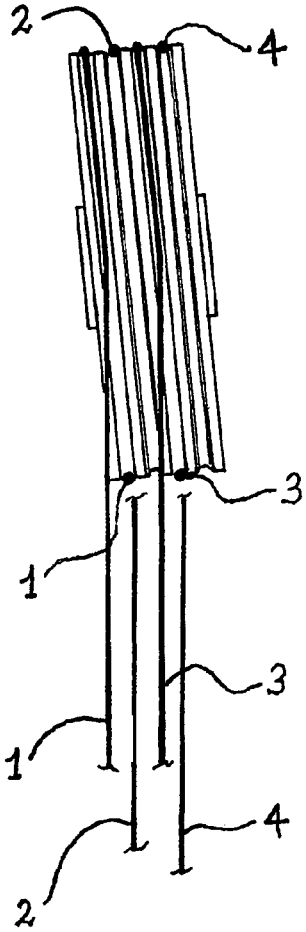
Fig. 6B
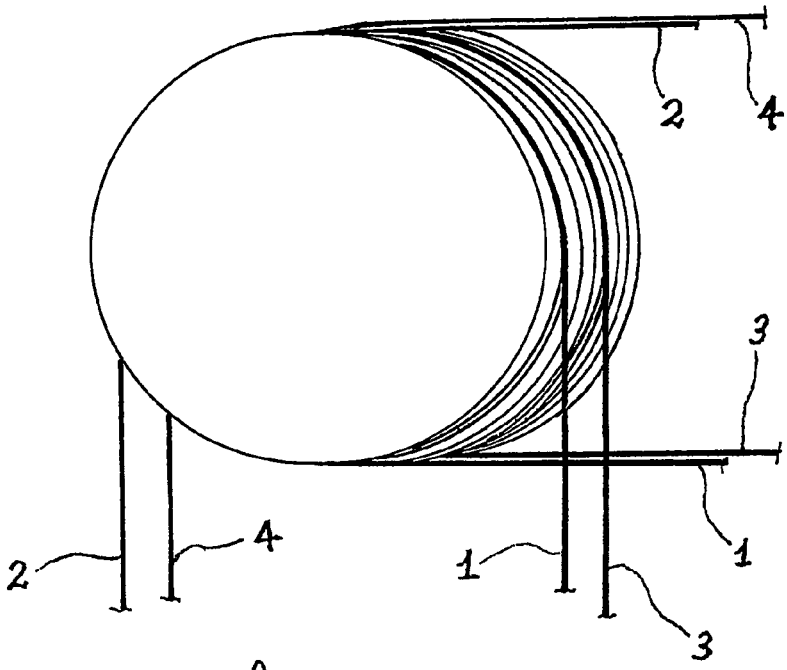
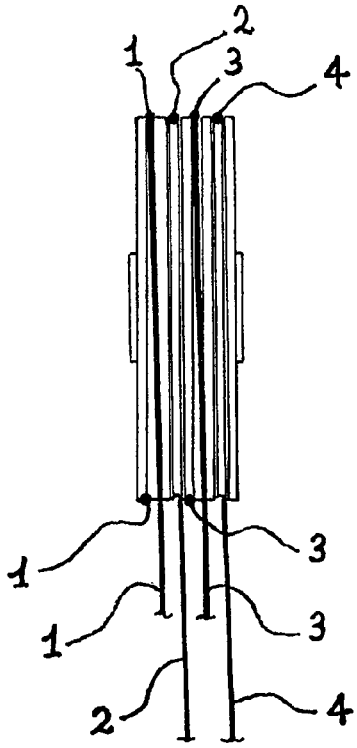
Fig. 6c

MACHINE-ROOM-LESS TRACTION SHEAVE ELEVATOR

BACKGROUND OF THE INVENTION

The present invention is about a traction sheave elevator, without the machine room.

As it is known, in the past, because of the norms that regulated the construction procedures, the installation of elevators and similar devices had to be equipped with appropriate spaces, named machine room, wherein the lifting apparatus and its respective actuation and control equipment were placed, causing thus the need of arranging technical spaces for such equipment, with its relative costs.

In more recent years, following the changes in the elevators' construction and installation regulations, different solutions have been adopted which do not require the presence of specific rooms suitable for the actuation equipment, since the traction machinery gets placed directly inside the elevator shaft or in any case somewhere within the shaft's walls dimensions, while the actuation and control equipment could have been placed inside a cabinet situated relative to the floor served by the elevator, connected with the upper or lower end, preferably, with the equipment's position.

Through the use of such apparatuses, which are described for example by the EP patents 0631968, 0680920, 0719724 and by many other documents, the maintenance operations can be carried out on the actuation and control equipment, operating on the landing where the cabinet is situated, in a position thus external to the shaft, while in order to access the equipment is necessary to be inside the elevator shaft, therefore without being able to simultaneously carry out the maintenance of the actuation or control equipment and the traction machinery.

In the above mentioned cases the equipment is accessible to the maintenance operations only from inside the shaft either by putting oneself over the elevator car's roof, or else by positioning oneself inside the shaft's lower end in the pit usually built below the elevator car, or even by operating through inspection doors placed into the shaft's side walls.

Another kind of solution that also provides a traction machinery inside the elevator shaft, as for example described in the EP patent 0922663, the accessibility to the equipment for the maintenance operations is possible thanks to a platform inside the shaft, to which the maintenance person must access in order to operate.

In this case, from the platform the maintenance person is able to simultaneously access the traction machinery as well as the actuation and control equipment, but however this solution does not fully allow the elevator to do its entire run during the maintenance operations, because of the presence of the platform inside the shaft; furthermore it is anyhow necessary to operate from inside the elevator shaft with all its relative difficulties.

In all of the previously described solutions, in the event that the elevator car gets stuck at the traction machinery working station's height inside the shaft, the access turns out to be seriously endangered or even prevented and thus the maintenance and/or rescue operations are considerably complicated.

SUMMARY OF THE INVENTION

The invention's object is indeed that of solving the previously described problems making a traction sheave elevator without the machine room, wherein an easy inspection and maintenance of both the drive machine and the actuation and control units would be possible, without having to build complex devices.

In the previously described scope a specific object of the invention is that of building an elevator where is possible to operate from outside the shaft in order to carry out the rescue operations, as well as in those cases where is necessary to operate on the traction sheave in case it is needed to free the elevator car after the parachute device intervention.

Another object of the present invention is that of reducing considerably the space required at the shaft's upper end, limiting at the same time the shaft's plan dimensions that need to be to a large extent those requested for the elevator car and counterweight placing, and of the possible safety space.

The last but not least object of this invention is that of building a traction sheave elevator, without the machine room, which is easily achievable starting from common market availability products and materials, and that furthermore is competitive at the economic level.

The above described object, together with the other mentioned objects and others that will appear later on, are accomplished by a traction sheave elevator, without the machine room, comprising an elevator car and a counterweight that run on respective guide rails placed in the shaft, the elevator car and the counterweight being suspended on at least one hoisting rope running over at least one traction sheave actuated by a drive machine and on diverting pulleys on the car and counterweight side, characterized in having a space outside said elevator shaft housing, at least partially, said drive machine and said space being equipped with an opening next to a floor's door for the access from outside said shaft to such drive machine and to said traction sheave.

BRIEF DESCRIPTION OF THE DRAWINGS

Further advantages and characteristics of a preferred, but not exclusive, embodiment of a traction sheave elevator, without the machine room, will be better highlighted in an explanatory but not limiting way through an examination of the following description, with reference to the annexed drawings wherein:

FIGS. 6A, 6B and 6C present in diagrammatic form the solution of arranging the two diverting pulleys on the same axis and body of the pulley.

DESCRIPTION OF THE PREFERRED EMBODIMENTS

Figure 1:
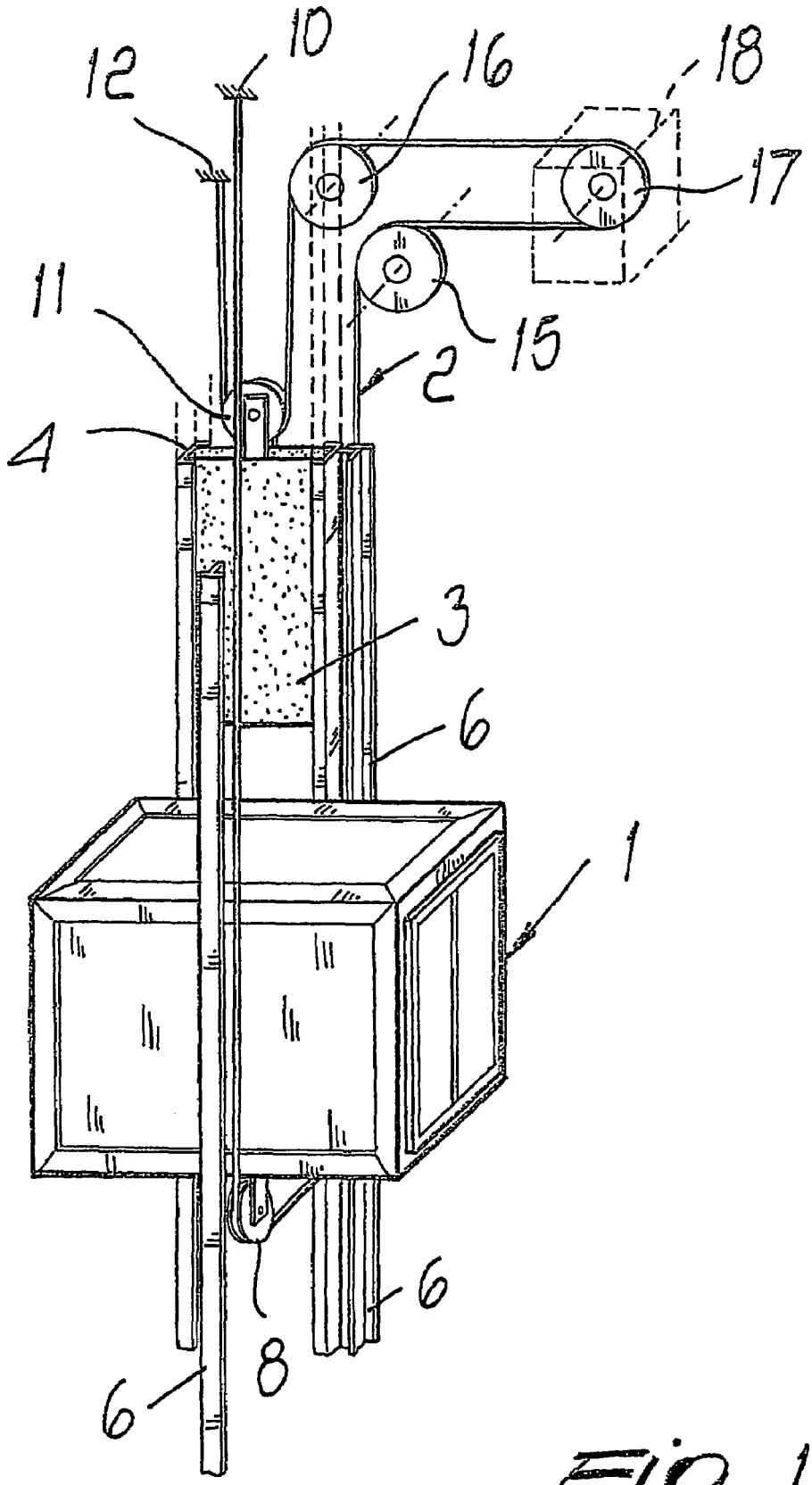
FIG. 1 presents in diagrammatic form an elevator according to the invention in isometric view.

Referring to the figures mentioned above, and particularly to FIGS. 1 and 2, the traction sheave elevator, without the machine room, according to the invention, comprises an elevator car 1 that is driven by hoisting ropes, generally and comprehensively indicated with the reference number 2, which can be of different size and have different developments according to the installation's needs.

A counterweight 3 that slides along its guide rails 4 is connected, through ropes 2, to the elevator car 1.

Figure 2:
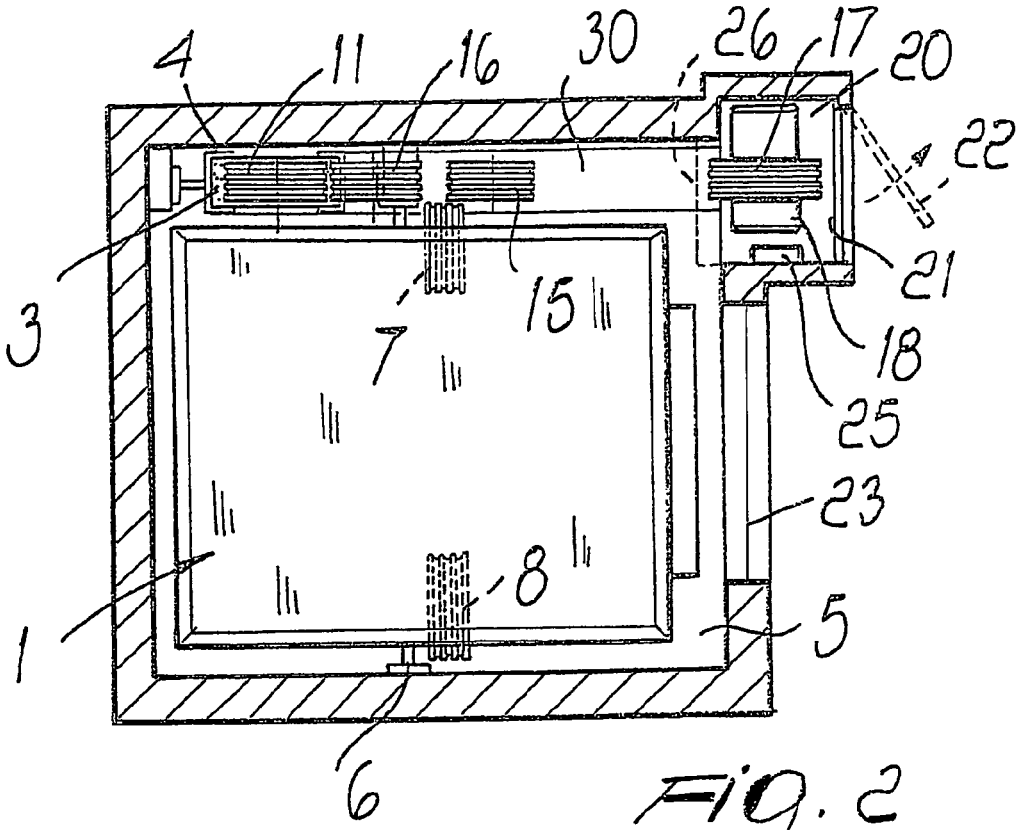
FIG. 2 presents in diagrammatic form a plan top view of the elevator of FIG. 1.

The elevator car 1, as illustrated in FIGS. 1 and 2, travels in the elevator shaft 5 along guide rails 6 opposed to each other for a preferably barycentric car's bearing.

The hoisting ropes bear the elevator car, preferably, in a way that the suspension's resultant would pass by near the plan projection of the car's barycentre and similarly also the suspension of the counterweight 3 is arranged so as to bear it preferably next to the plan projection of its barycentre.

For this purpose, lower sheaves 7 and 8 are provided that are connected to the lower part of the elevator car around which the ropes 2 run and have a first end 10 anchored to a fixed point.

In the same way a sheave 11 is provided for the counterweight, over which ropes 2 are running and have a second end 10 anchored to a fixed point. Some diverting pulleys are then provided, the pulley directed towards the elevator car is indicated with the number 15 and the pulley 16 directed towards the counterweight, which basically allow diverting the ropes coming from the traction sheave 17.

The traction sheave 17 is operated by a drive machine 18 that has the characteristic of being at least inserted in a space 20, which is outside the elevator shaft and is equipped with an opening 21 that is accessible from the outside, for example through an inspection door 22 that is situated near the floor's door 23 and, advantageously, is practically placed next to the sidewall of the floor's door.

In the embodiment the drive machine 18 is arranged in such a way that the traction sheave 17 can be partially into the elevator shaft and with the remaining part situated in the space 20 that is easily accessible from the outside.

Usefully, the free accessibility to the drive machine 18 is limited by the inspection door 22 which is equipped with closable openings that allow the access to the drive machine only to authorized personnel.

In the space 20, which is basically a cabinet for the machinery, can be placed, in addition to the drive machine, also the other elevator's equipment such as the control board, the motor's actuator, the emergency maneuver tools and alike that are generally indicated with the number 25 in the drawings.

The opening in the shaft's walls for the housing of the machinery is shielded on the shaft side by protection panels, indicated with the number 26, which prevent the operator to freely access the mobile equipments placed inside the elevator shaft with the risk of being injured.

The hoisting ropes 2 run from the traction sheave 17 to the diverting pulleys 15 and 16 directly or through other kinds of pulleys that are not shown in the figure.

The upper end of the car's guide rails 6 can be connected by a framework, generally indicate with the number 30 in the drawing, and an opposing horizontal structure of the drive machine 18 can be also provided, in order to balance the horizontal loads caused by the hoisting ropes traction.

Making specific reference to FIG. 1, the hoisting ropes have a first end anchored to a fixed point 10 which is situated in the elevator shaft's upper part of the travel of the car 1, while the second end is anchored to a fixed point 12 on the framework 30 and from there the ropes run down the sheave 11 that is connected to the counterweight 3; obviously both the number and arrangement of the sheaves as well as the development of the ropes can be modified, not being itself a characteristic element of this invention.

Figure 4:
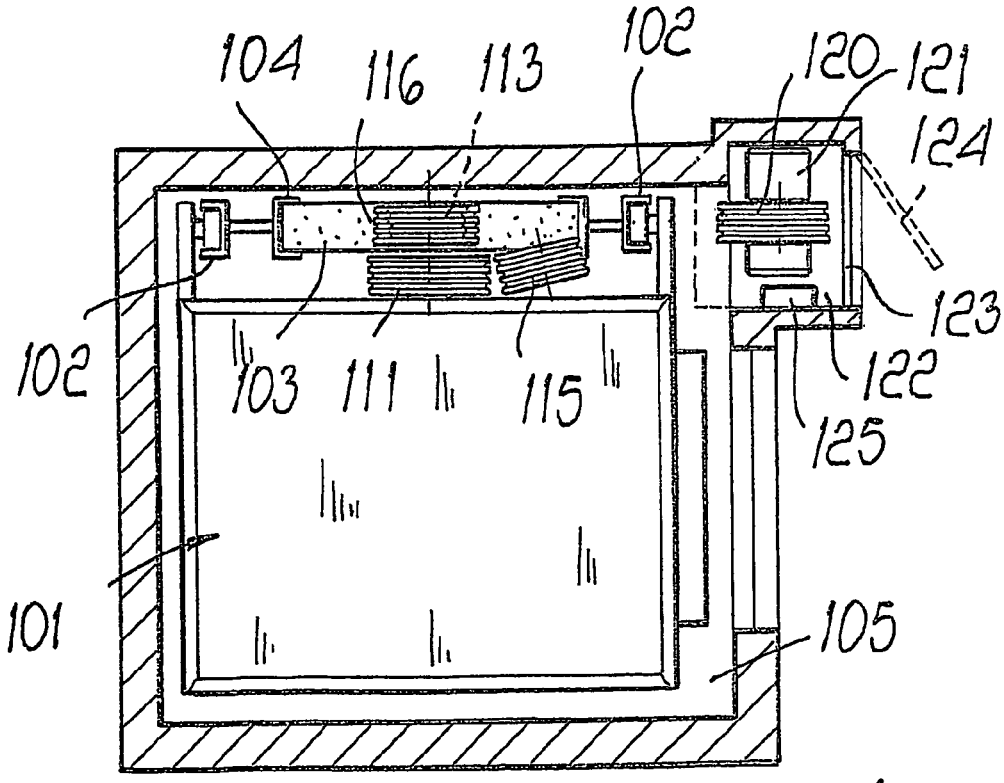
FIG. 4 presents a plan top view of the elevator of FIG. 3.
Figure 3:
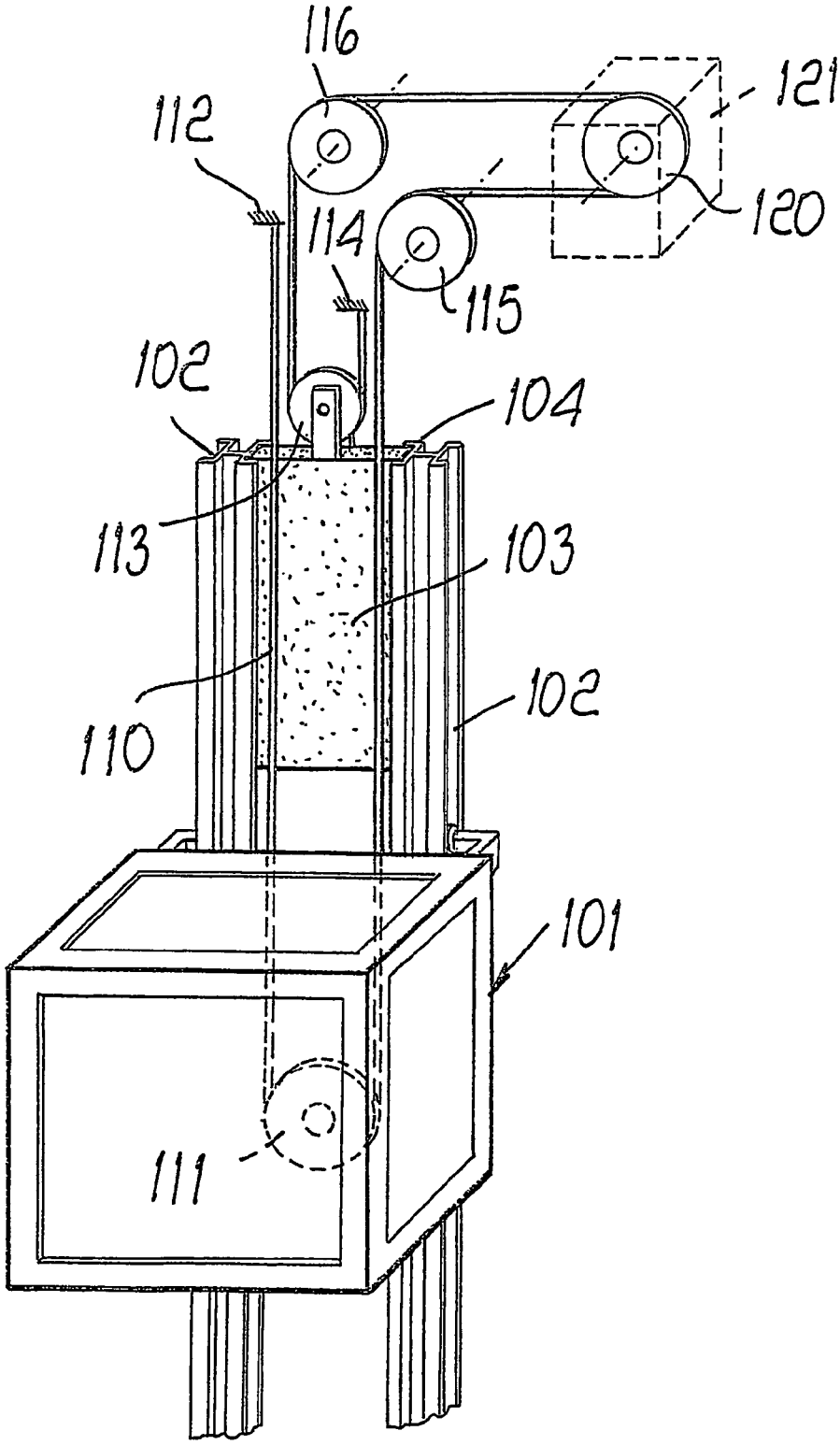
FIG. 3 presents in diagrammatic form a different embodiment of the elevator in isometric view.

Making specific reference to FIGS. 3 and 4, a structurally different embodiment is described but that theoretically makes use again of the previously examined features.

More specifically, an elevator car 101 is provided which is mounted on vertical guide rails 102 that supply the car with a Rucksack kind of suspension.

The counterweight 103 travels along the guide rails 104 that are sided by the guide rails 102 and that turn out to be placed on the same side of the elevator car relative to the wall of the shaft 105.

The hoisting rope 110 runs over a car's sheave 111 which is not connected to the car's side directed towards the guide rails 102 and that reaches a first upper fixed point 112.

Similarly the counterweight 103 is equipped with its upper sheave 113 on which the other end of the hoisting ropes 102 runs in order to reach a second upper fixed point 114.

Upper diverting pulleys are provided indicated with the number 115 for the section that runs to the car, and with the number 116 for the section that runs to the counterweight respectively, which are basically placed at the exit of the main traction sheave 120 that is connected to a drive machine 121 which is housed into a space 122 that is situated outside the elevator shaft and is equipped with a closed opening 123, an inspection door 124 for simultaneous access to the drive machine and to the traction sheave, as well as to possible additional equipment 125.

As illustrated in FIG. 4 in diagrammatic form the diverting pulleys can be offset in order to make the pulleys' arrangement easier.

It is clear from what has been previously described how the invention achieves the proposed objects and it is particularly highlighted the fact that an elevator is built where there is a space, outside the shaft, which houses, at least partially, both the drive machine and the traction sheave and that is equipped with an opening which is situated near a floor's door thus allowing the simultaneous access, from outside the shaft, to both the drive machine and the traction sheave, and also to possible actuation and control equipments.

This arrangement that constitutes the present invention's distinctive element, can be applied to any kind of equipment, regardless of the type of suspension, either direct or tackle, utilized for the elevator car and for the counterweight and also regardless of the kind of hoisting ropes that can be of the flat type too or can be made of belts or similar elements.

Similarly, it must be noticed that is possible to use different arrangements for the traction sheave which can have a rotation plane substantially parallel to the car's sides plane, from the diverting pulleys side or, eventually, it can be arranged with a traction sheave" rotation plane largely parallel or slightly tilted with respect to the horizontal plane, always compatible with the kind of connection to the used ropes.

It must also be added to what has been previously said that the invention's solution is embodied by the presence of the space outside the elevator shaft, which is accessible through an opening made in the same wall of the floor's door, so as to simultaneously access to the drive machine and the traction sheave. Such solution can be applied in any case to all kinds of installation like, for example, the insertion with barycentric bearing car or Rucksack suspension car. When diverting pulleys are used in elevators, it is very important that the distance between the latter ones and the traction sheave be greater than 200 times the hoisting ropes' diameter, or that the ropes would run in the same direction on the contiguous sheaves, regardless of the distance between the sheaves.

These conditions guarantee a lower wear of the ropes and thus allow adopting lower safety coefficients.

On the other hand, it is also important that the ropes' contact angle on the traction sheave be sufficiently large in order to guarantee the needed grip between the ropes and the traction sheave.

The EP patent 0565956 B1 is able to obtain contact angles on the traction sheave greater than 180 degrees, thanks to a solution which allows the ropes that wrap around the traction sheave to cross without any interference. This solution however presents the two diverting pulleys placed on the same side with respect to the traction sheave, but the ropes running direction on one of the two diverting pulleys is the opposite direction with respect to the ropes running direction on the traction sheave. This causes a greater fatigue of the ropes, unless the distance between the diverting pulley and the traction sheave is greater than 200 times the hoisting ropes' diameter, therefore requiring the use of a higher safety coefficient.

The solution presented by the EP patent 0578237 A1 is also able to obtain contact angles on the traction sheave greater than 180 degrees, and it further allows the ropes running over the diverting pulleys in the same wrapping direction on the traction sheave. Even in this case the hoisting ropes that enter the traction sheave" grooves cross before wrapping around the diverting pulleys, without interfering with each other.

In this case each one of the two diverting pulleys is placed on different sides with respect to the traction sheave.

In the case where the two diverting pulleys must be placed on the same side relative to the traction sheave and their distance from the traction sheave itself can not be greater than 200 times the ropes' diameter, none of the solutions presented by the two previously mentioned patents allows the ropes to run on the pulleys in the same direction with respect to the traction sheave. This result can be achieved by conveniently adopting the arrangement illustrated in FIG. 5 and described below.

Figure 5:
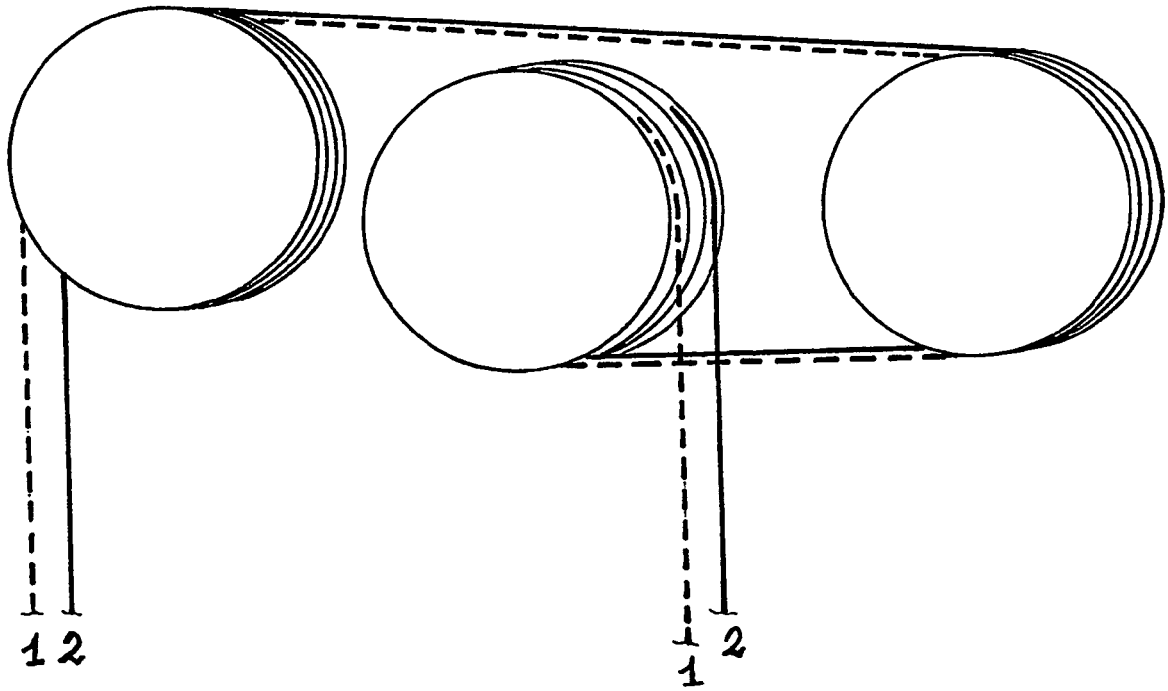
FIG. 5 presents in diagrammatic form the solution of arranging the two diverting pulleys tilted with respect to the vertical.

Referring now to FIG. 5, the rope coming from the traction sheave" lower side enters the grooves' lower side of the diverting pulley 1, runs on it for at least three fourth of the round and travels on in vertical direction e.g. towards the elevator car. In order to avoid that the rope's horizontal section which enters the diverting pulley and the vertical section that from the diverting pulley runs towards the car would touch one another, the diverting pulley's rotation plane is tilted of about 3-4 degrees with respect to the vertical, in a way that the rope's vertical section would be shifted with respect to the horizontal section of a sufficient amount in order to avoid the interference. The rope's section coming from the traction sheave" upper side enters the grooves' upper side of the diverting pulley 2, runs on it for about one fourth of the round and travels on in vertical direction e.g. towards the counterweight. It is not necessary that the rotation plane of the diverting pulley 2 were tilted relative to the vertical plane.

This solution of ropes wrapping on the diverting pulleys causes the running direction to be the same for the diverting pulleys and for the traction sheave.

The diverting pulleys on the counterweight and on the elevator car can be anchored to a load bearing structure which releases a good amount of the vertical thrusts on the guide rails, both the counterweight's rails and car's rails placed on the same side.

A preferred solution is that of arranging the two pulleys on the same axis, on the same pulley's body, with the alternating ropes' grooves, namely one groove for a rope that runs in the counterweight direction alternated with a groove for the rope that runs in the car direction.

The hoisting ropes that run in the counterweight direction and those that run in the car direction are also arranged as so to cause the pulleys to rotate in the same direction. In order to obtain such result, one of the hoisting ropes must run on the pulley's upper side, for about one fourth of a round, and then go towards the suspended element, namely the counterweight.

The other rope must run on the pulley starting from the lower side, for about ¾ of a round and subsequently go towards the other suspended element, namely the elevator car.

In order to avoid that the rope which wraps itself ¾ of a round would run downward interfering with the rope's section entering the pulley, the sheave is positioned slightly tilted with respect to the vertical plane, with such an angle to allow the rope's section vertically running downward from the pulley not to touch the rope's section entering the sheave' groove.

Basically, the rope vertically leaving the pulley passes by roughly at the groove's height wherein one of the nearby ropes rests, such ropes running only for one fourth of a round on the sheave. In this manner, the two sections of the same rope which runs for about ¾ of a round on the pulley can cross without any interference, also allowing to have a sheave with a total thickness equal to that needed to place the entire number of ropes, which usually does not leave crossing space.

Because the pulley's angle in order to allow the ropes crossing, can cause a too high lateral wear of the ropes and their respective grooves, a further advantage is obtained making the ropes, coming from the traction sheave, entering the diverting pulley with a small skew angle, equal to about half the angle which the pulley should be tilted of in order to allow the crossing. In this manner, the diverting pulley's skew angle can be reduced in half.

In this fashion, the maximum offset angle between the rope and the pulley's groove is reduced and it is divided on both sides of the grooves and the ropes, reducing and compensating for the wear caused by the drag of the ropes on the grooves' side.

This preferred solution of a single diverting pulley's body with four grooves is illustrated in FIGS. 6A, 6B and 6C, wherein FIG. 6A is a front view, FIG. 6B is a side view relative to 6A, and FIG. 6C is a bottom view according to a non-vertical plane, but tilted with respect to the vertical with the same angle of the pulley.

The hoisting ropes 1 and 3 go to the elevator car and the ropes 2 and 4 go to the counterweight, or vice-versa.

The skew angle should not be greater than 4°.

If the pulley's skew angle decreases, possibly to a value of 2°, the crossing ropes run the risk of touching each other.

In this case, also the hoisting ropes 1 and 3 which run horizontally must enter the grooves with a slight angle, so not to interfere with the sections of the ropes 1 and 3 that vertically run downward, as shown in FIG. 6C.

The ropes running downward to the elevator car side cross with the section coming from the drive machine, roughly in the space relative to the groove wherein the ropes running in the counterweight direction enter (except for the last rope on the diverting pulley's front side).

The lower sections of the hoisting ropes coming (almost horizontally, but not necessarily) from the drive machine enter the diverting pulley's grooves with a lateral skew angle almost equal to the vertical skew angle of the diverting pulley.

The invention designed in this fashion is subject to several variations and modifications, without falling out of the scope of protection.

Furthermore, all the details can be substituted by other technically equivalent elements. Basically, according to the needs, it can be used whatever material as well as any size or shape of its elements.

The invention claimed is:

1. A traction sheave elevator, without the machine room, comprising an elevator car and a counterweight that run on respective guide rails placed in the shaft, the elevator car and the counterweight being suspended on at least one hoisting rope running over at least one diverting pulley driven by a traction sheave wherein the diverting pulleys are located on the car and counterweight side, characterized in having, near to a floor's landing door, a space outside the elevator shaft, projecting towards the landing side and housing, at least partially, comprises a drive machine, and said space being equipped with an inspection door controlling an opening in the sidewall next to said floor's landing door, for the access from the door landing side to said drive machine and to said traction sheave, where the traction sheave is laying, at least partially, on the landing side of the plane of the elevator landing door front, and wherein said space comprising said machine is not part of a front wall pocket designed to contain the landing door when in an open position.

2. The elevator, according to claim 1, characterized by comprising, inside said space, the other equipments for the operative control of said elevator.

3. The elevator, according to claim 1, characterized by comprising protection panels placed between said space and said elevator shaft in order to prevent access to said shaft from said space.

4. The elevator, according to claim 1, characterized in that said traction sheave has a rotation axis substantially perpendicular to the plane of the car's wall on the diverting pulleys and the counterweight side.

5. The elevator, according to claim 1, characterized in that said traction sheave has a rotation axis substantially perpendicular to a vertical plane.

6. The elevator, according to claim 1, characterized in that said traction sheave has a rotation axis substantially perpendicular to a horizontal plane.

7. The elevator, according to claim 1, characterized in that said traction sheave has a rotation axis tilted with respect to the horizontal plane.

8. The elevator, according to claim 1, characterized in that the diverting pulleys of the hoisting ropes running from the machine's traction sheave to the car and counterweight suspension sheaves, are coaxial and the ropes run on said pulleys in the same direction, as the pulleys have the same rotational direction as the traction sheave, the plane of rotation of the diverting pulleys being approximately parallel to the plane of rotation of the traction sheave, within range of +/− 4 degrees in addition to the commonly acceptable tolerances.

9. The elevator, according to claim 8, characterized in that the diverting pulley has a number of grooves that is at least double the number of hoisting ropes and the ropes coming from the traction sheave alternately enter the diverting pulleys' grooves, a rope traveling toward the car's suspension alternating with a rope traveling toward the counterweight suspension.

10. The elevator, according to claim 9, characterized in that the diverting pulley has the rotation plane tilted with respect to the vertical, so that the contact angle of a section of the ropes running on the diverting pulley exceeds 180° and, exiting the pulley's groove, while running downward towards the suspension, crosses with the section of the rope which enters the same pulley's groove, coming from the traction sheave.

11. The elevator, according to claim 10, characterized in that the hoisting ropes coming from traction sheave enter the diverting pulley's groove with a skew angle, with respect to the grooves' plane, about equal to the skew angle of the pulley's plane with respect to the vertical plane.

12. The elevator, according to claim 2, characterized in that the diverting pulleys of the hoisting ropes running from the machine's traction sheave to the car and counterweight suspension sheaves, are coaxial and the ropes run on said pulleys in the same direction, as the pulleys have the same rotational direction as the traction sheave, the plane of rotation of the diverting pulleys being approximately parallel to the plane of rotation of the traction sheave, within range of +/− 4 degrees in addition to the commonly acceptable tolerances.

13. The elevator, according to claim 3, characterized in that the diverting pulleys of the hoisting ropes running from the machine's traction sheave to the car and counterweight suspension sheaves, are coaxial and the ropes run on said pulleys in the same direction, as the pulleys have the same rotational direction as the traction sheave, the plane of rotation of the diverting pulleys being approximately parallel to the plane of rotation of the traction sheave, within range of +/−4 degrees in addition to the commonly acceptable tolerances.

14. The elevator, according to claim 4, characterized in that the diverting pulleys of the hoisting ropes running from the machine's traction sheave to the car and counterweight suspension sheaves, are coaxial and the ropes run on said pulleys in the same direction, as the pulleys have the same rotational direction as the traction sheave, the plane of rotation of the diverting pulleys being approximately parallel to the plane of rotation of the traction sheave, within range of +/− 4 degrees in addition to the commonly acceptable tolerances.

15. The elevator, according to claim 5, characterized in that the diverting pulleys of the hoisting ropes running from the machine's traction sheave to the car and counterweight suspension sheaves, are coaxial and the ropes run on said pulleys in the same direction, as the pulleys have the same rotational direction as the traction sheave, the plane of rotation of the diverting pulleys being approximately parallel to the plane of rotation of the traction sheave, within range of +/− 4 degrees in addition to the commonly acceptable tolerances.

16. The elevator, according to claim 12, characterized in that the diverting pulley has a number of grooves that is at least double the number of hoisting ropes and the ropes coming from the traction sheave alternately enter the diverting pulleys' grooves, a rope traveling toward the car's suspension alternating with a rope traveling toward the counterweight suspension.

17. The elevator, according to claim 16, characterized in that the diverting pulley has the rotation plane tilted with respect to the vertical, so that the contact angle of a section of the ropes running on the diverting pulley exceeds 180° and, exiting the pulley's groove, while running downward towards the suspension, crosses with the section of the rope which enters the same pulley's groove, coming from the traction sheave.

18. The elevator, according to claim 17, characterized in that the hoisting ropes coming from traction sheave enter the diverting pulley's groove with a skew angle, with respect to the grooves' plane, about equal to the skew angle of the pulley's plane with respect to the vertical plane.

19. The elevator, according to claim 13, characterized in that the diverting pulley has a number of grooves that is at least double the number of hoisting ropes and the ropes coming from the traction sheave alternately enter the diverting pulleys' grooves, a rope traveling toward the car's suspension alternating with a rope traveling toward the counterweight suspension.

20. The elevator, according to claim 19, characterized in that the diverting pulley has the rotation plane tilted with respect to the vertical, so that the contact angle of a section of the ropes running on the diverting pulley exceeds 180° and, exiting the pulley's groove, while running downward towards the suspension, crosses with the section of the rope which enters the same pulley's groove, coming from the traction sheave.

* * * * *